US012054299B2

(12) United States Patent
Conti

(10) Patent No.: US 12,054,299 B2
(45) Date of Patent: Aug. 6, 2024

(54) PACKAGING MACHINE FOR MAKING FILTER BAGS WITH INFUSION PRODUCTIONS

(71) Applicant: I.M.A. INDUSTRIA MACCHINE AUTOMATICHE S.p.A., Ozzano Dell'Emilia (IT)

(72) Inventor: Roberto Conti, Imola (IT)

(73) Assignee: I.M.A. INDUSTRIA MACCHINE AUTOMATICHE S.P.A., Ozzano Dell'Emilia (IT)

( * ) Notice: Subject to any disclaimer, the term of this patent is extended or adjusted under 35 U.S.C. 154(b) by 270 days.

(21) Appl. No.: 17/638,099

(22) PCT Filed: Sep. 25, 2020

(86) PCT No.: PCT/IB2020/058981
§ 371 (c)(1),
(2) Date: Feb. 24, 2022

(87) PCT Pub. No.: WO2021/064528
PCT Pub. Date: Apr. 8, 2021

(65) Prior Publication Data

US 2022/0289413 A1 Sep. 15, 2022

(30) Foreign Application Priority Data

Sep. 30, 2019 (IT) ..... 102019000017489

(51) Int. Cl.
*B65B 35/16* (2006.01)
*B65B 29/02* (2006.01)
(Continued)

(52) U.S. Cl.
CPC ..... *B65B 29/028* (2017.08); *B65B 35/16* (2013.01); *B65B 35/32* (2013.01); *B65B 35/50* (2013.01); *B65B 35/56* (2013.01); *B65B 61/28* (2013.01)

(58) Field of Classification Search
USPC ..... 53/574
See application file for complete search history.

(56) References Cited

U.S. PATENT DOCUMENTS

2002/0139086 A1 10/2002 Ghirlandi

FOREIGN PATENT DOCUMENTS

CN 101454207 A 6/2009
CN 103387072 A 11/2013
(Continued)

OTHER PUBLICATIONS

Chinese Office Action dated Feb. 24, 2023 from counterpart Chinese Patent Application No. 202080068837.3.
(Continued)

*Primary Examiner* — Chinyere J Rushing-Tucker
(74) *Attorney, Agent, or Firm* — SHUTTLEWORTH & INGERSOLL, PLC; Timothy J. Klima

(57) ABSTRACT

A packaging machine for making filter bags with infusion products includes a plurality of processing stations defining a processing path for making filter bags with infusion products and an extraction station situated immediately downstream of the processing path. The extraction station comprises a stacking unit having a guide channel to allow the ordered and continuous feeding of the filter bags and a transfer device for transferring the filter bags coming from the processing path to the stacking unit. The stacking unit includes a connecting element positioned downstream of the processing stations and upstream of the guide channel for receiving as input from the transfer device the filter bags
(Continued)

coming from the processing path. The connecting element is connected at the outlet with the guide channel and includes a chute surface having a curved stretch shaped to allow feeding of the filter bags along a feed direction.

13 Claims, 4 Drawing Sheets

(51) Int. Cl.

| | |
|---|---|
| ***B65B 35/32*** | (2006.01) |
| ***B65B 35/50*** | (2006.01) |
| ***B65B 35/56*** | (2006.01) |
| ***B65B 61/28*** | (2006.01) |

(56) References Cited

FOREIGN PATENT DOCUMENTS

| | | | | | |
|---|---|---|---|---|---|
| CN | 103402875 | A | | 11/2013 | |
| CN | 110088000 | A | | 8/2019 | |
| EP | 3393915 | A1 | | 10/2018 | |
| EP | 3487768 | A1 | * | 5/2019 | ..... B65B 29/028 |
| EP | 3487768 | A1 | | 5/2019 | |
| EP | 3487768 | B1 | | 9/2020 | |

OTHER PUBLICATIONS

International Search Report and Written Opinion dated Jan. 13, 2021 from counterpart International Patent Application No. PCT/IB2020/058981.

* cited by examiner

PACKAGING MACHINE FOR MAKING FILTER BAGS WITH INFUSION PRODUCTIONS

This application is the National Phase of International Application PCT/IB2020/058981 filed Sep. 25, 2020 which designated the U.S.

This application claims priority to Italian Patent Application No. 102019000017489 filed Sep. 30, 2019, which application is incorporated by reference herein.

TECHNICAL FIELD

This invention relates to the technical sector of packaging machines for making filter bags with infusion products.

In particular, the invention relates to a packaging machine of the type suitable for making infusion products (tea, coffee, camomile and the like)

BACKGROUND ART

Generally speaking, the prior art packaging machines comprise a plurality of processing stations at which respective steps are performed which contribute to making the infusion products.

The products are usually made by means of bags made of filter material inside of which at least one dose of a substance designed to be infused is enclosed.

A thread is also associated with the bags which allows the bag to be connected to a gripping tag, making a product ready for grouping and suitably stacked at an outfeed area of the machine which is usually followed by a station for final packaging of infusion products in suitable containers or boxes.

Before the stacking of the filter bags, a packaging of each individual bag may also be made with a sheet of overwrapping material suitably folded and sealed on the bag to form an individual packet with a closed filter bag inside it.

In order to reduce the complexity, the overall size and total cost of the packaging machine the prior art teaches the production of solutions for manual packaging of the bags, wherein at the end of the production process the finished products are manually picked up by the machine and inserted in the respective containers/boxes according to a predetermined number.

For this purpose, it is necessary to prepare an outfeed station which is able to allow a regular conveying of the bags (with or without overwrapping) in succession and with the possibility of manual picking up by an operator.

It is also necessary to be able to define predetermined groups of successive products (in a predetermined number which can at the same time be modified by the operator, to take into account any size changeover of the containers or boxes in which the product will be inserted) so as to allow a fast and optimum picking up by the operator.

In the sector there are prior art packaging machines comprising outfeed stations in which the finished products are grouped together and conveyed along a guide channel having at the top an opening through which the operator can access the products for picking them up and extracting them from the machine.

However, the Applicant has found certain problems which affect the efficiency and the usability of the prior art packaging machines.

In particular, the prior art machines have outfeed stations which are not very effective and require complex transfer mechanisms to correctly perform the passage of the products from the processing stations to the outfeed station.

Aim of the Invention

In this context, the technical purpose which forms the basis of the invention is to provide a packaging machine for making filter bags with infusion products which overcomes the above-mentioned drawbacks of the prior art.

In particular, the aim of the invention is to provide a packaging machine for making filter bags with infusion products which is able to optimise the process for moving the filter bags inside the machine, in particular after completing the production of the individual filter bags and during their preparation for packaging in groups of predetermined dimensions and subsequent extraction.

The technical purpose indicated and the aims specified are substantially achieved by a packaging machine for making filter bags with infusion products comprising the technical features described in one or more of the accompanying claims.

The invention relates to a packaging machine for making filter bags with infusion products comprising a plurality of processing stations defining a processing path and configured for making filter bags and an outfeed station situated immediately downstream of the processing path.

The outfeed station in turn comprises a guide channel along which is defined a succession of ordered and continuous filter bags and which has a first curved stretch designed to receive as input the filter bags from the processing path and a second flat stretch designed to allow their extraction from the machine.

The outfeed station also comprises transfer means configured for transferring the filter bags from the processing path to the first stretch of the guide channel.

Advantageously, the machine according to the invention optimises the control of the spaces and facilitates the movement of the filter bags and their splitting into groups of predetermined dimensions.

The dependent claims, incorporated herein for reference, relate to different embodiments of the invention.

BRIEF DESCRIPTION OF THE DRAWINGS

Further features and advantages of the present invention are more apparent in the non-limiting description of a preferred embodiment of it, as illustrated in the accompanying drawings, in which.

DETAILED DESCRIPTION OF PREFERRED EMBODIMENTS OF THE INVENTION

In the accompanying drawings, the numeral 1 generically denotes a packaging machine for making filter bags with infusion products, hereinafter denoted simply as the machine 1.

The machine 1 comprises a plurality of processing stations 2 arranged in a precise order designed at defining a processing path along which the filter bag is progressively assembled with infusion products referred to below as infusion product "I".

Figure 1:
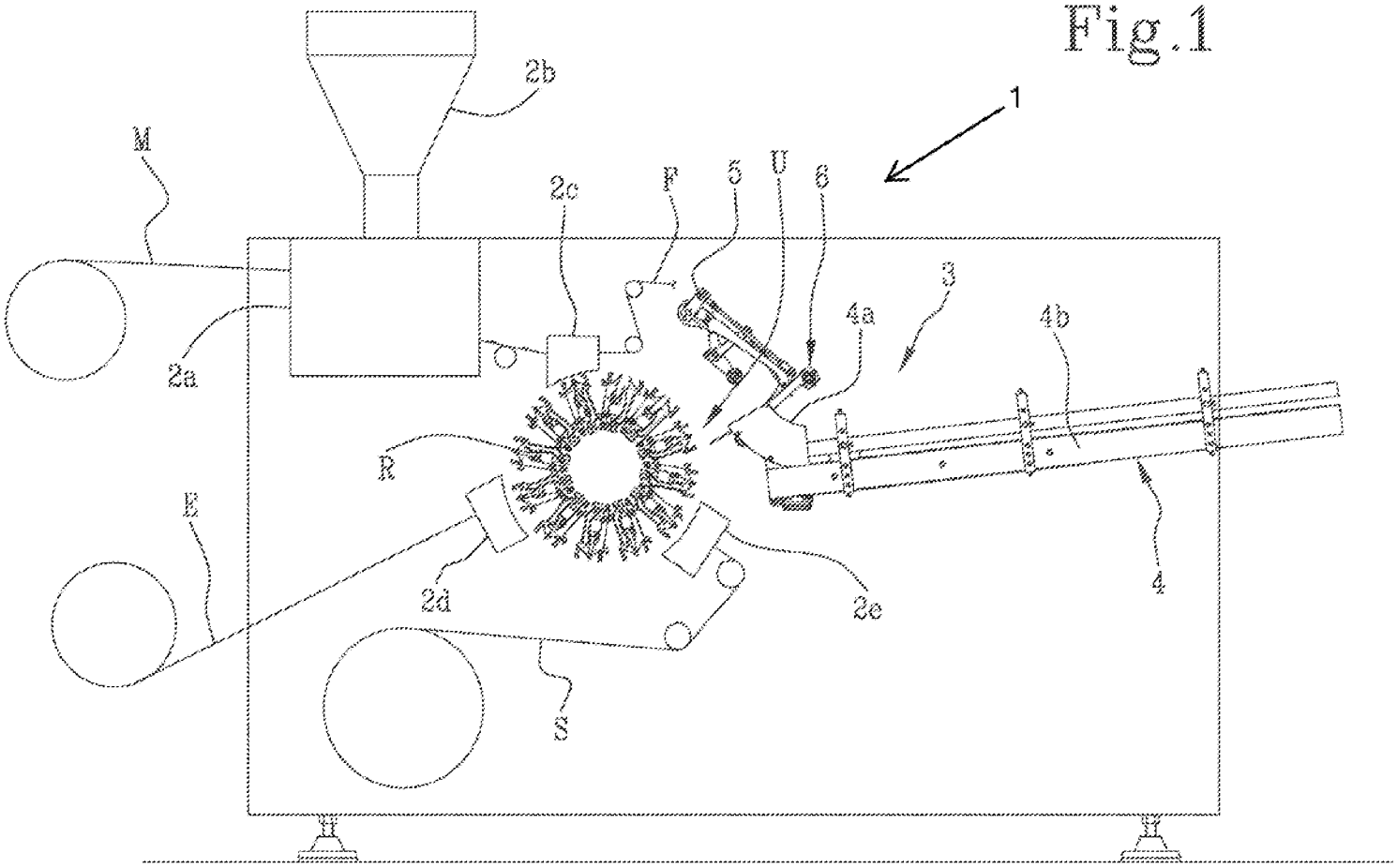
FIG. 1 shows in general a diagram of a packaging machine for making filter bags with infusion products according to the invention.
Figure 2:
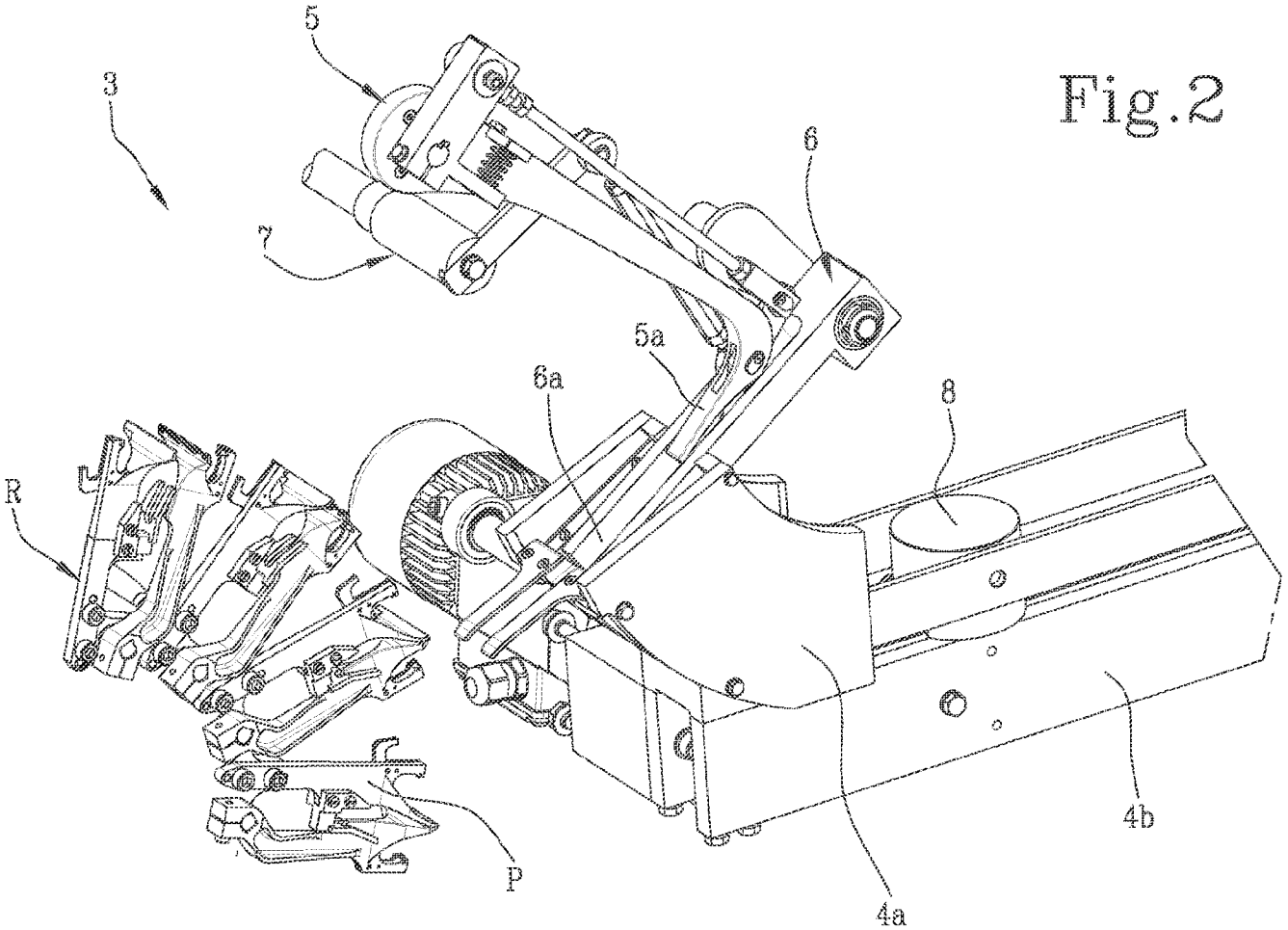
FIG. 2 shows in detail a view of an outfeed station of the packaging machine for making filter bags with infusion products of FIG. 1.
Figure 3:
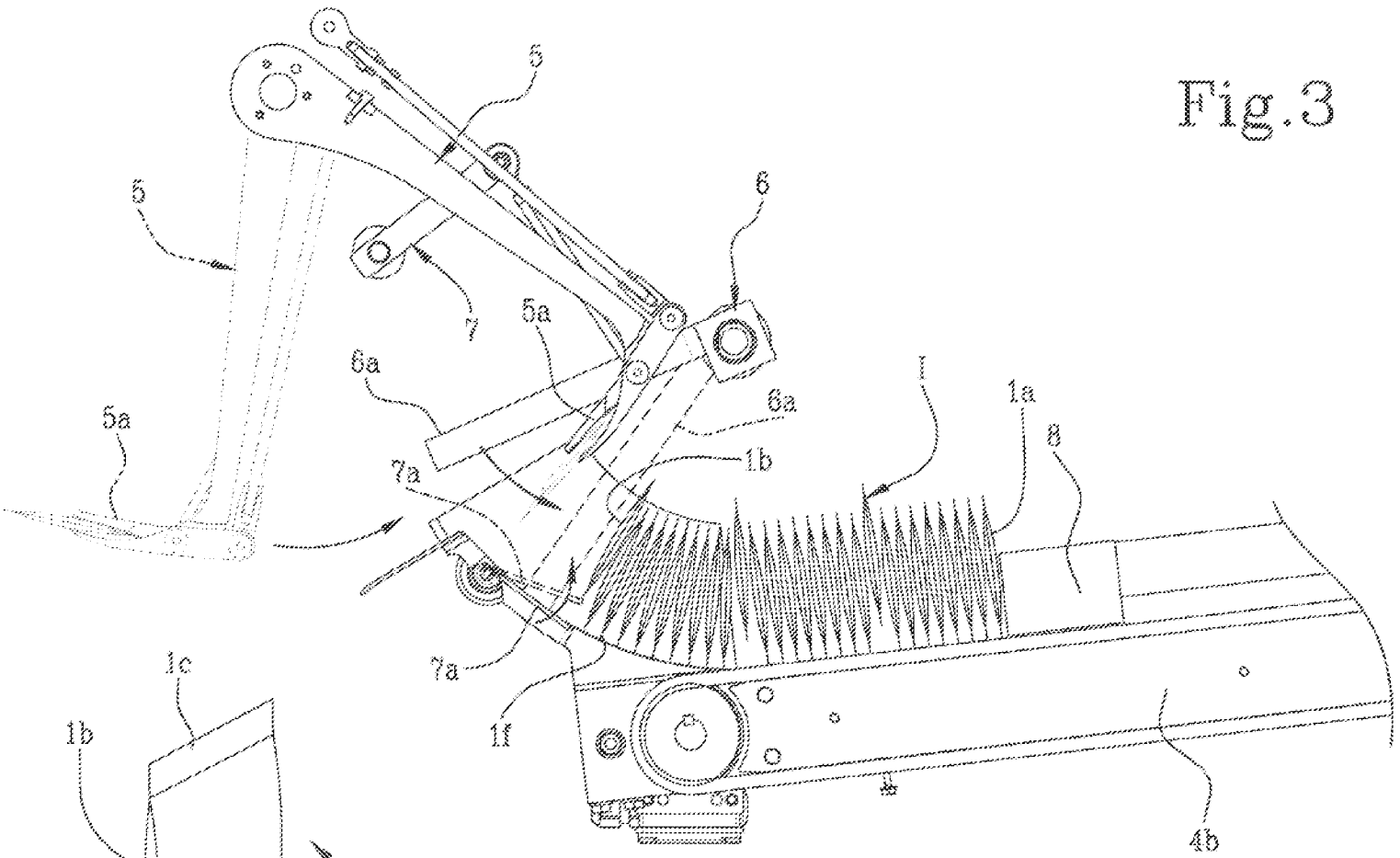
FIG. 3 shows a cross-section of the outfeed station of FIG. 2 showing the movements of some elements.
Figure 5:
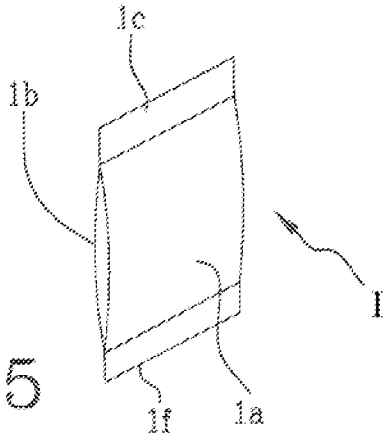
FIG. 5 shows a schematic perspective view of a filter bag made with the packaging machine according to the invention.
Figure 4:
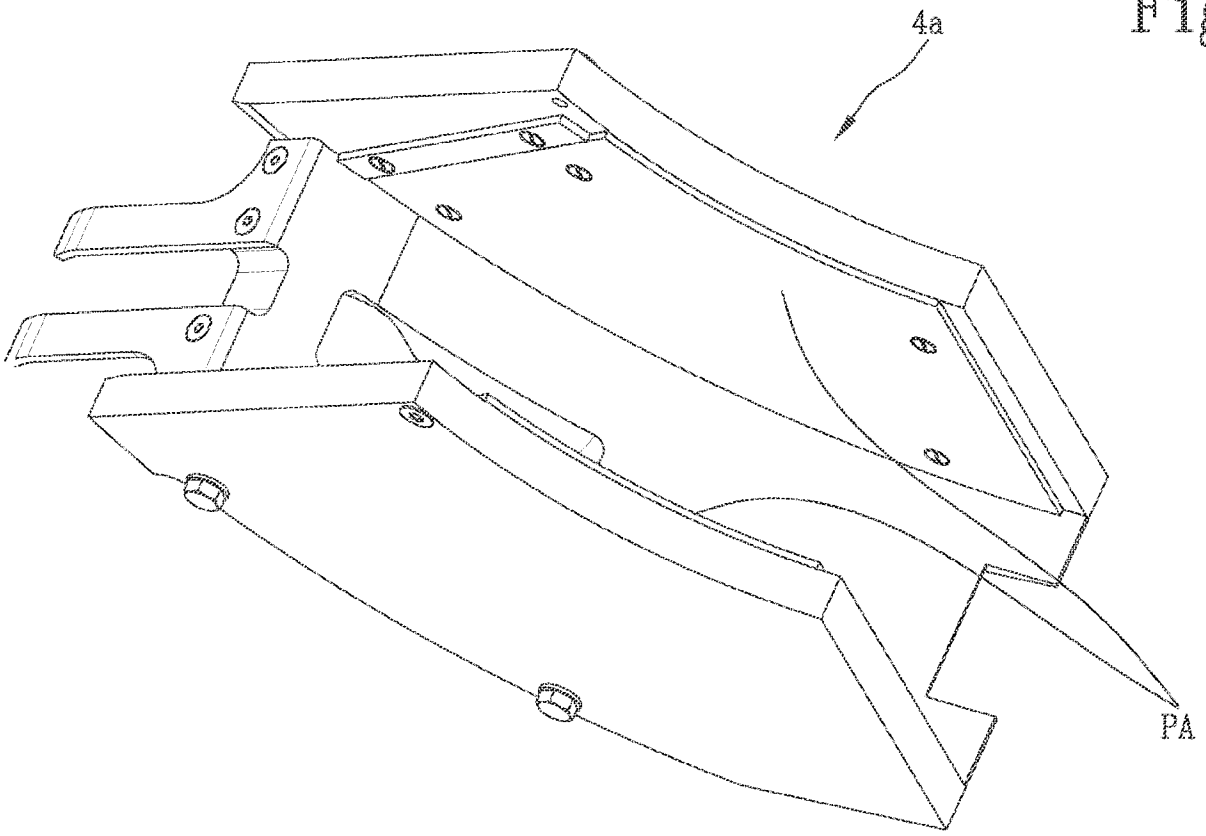
FIG. 4 shows a detail of the outfeed station.

The filter bag I (see FIG. 5) comprises at least one containment chamber having two outer faces 1*a*, 1*b* with larger dimensions facing each other and two sides which extend from a bottom 1*f* and from a top 1*c*.

The bottom 1*f* and the top 1*c* have an extension smaller than both the two large faces 1*a*, 1*b* and the sides.

This configuration of the filter bag I may vary in its configuration, but the geometry described is the same.

By way of a non-limiting example, the processing stations 2 may comprise a succession of stations designed to make filter bags starting from pieces of filter material and containing one dose (single-lobed bag) or two doses (two-lobed bag) of a substance suitable for infusion (such as, for example, tea, coffee, camomile or the like, and flavouring substances) and applying to these bags a portion of thread having at one end a gripping tag, whilst at the other end, the thread is associated with the filter bag.

Optionally, the processing stations may also comprise a station designed for applying a sheet of overwrapping material to the filter bag after application of the thread and the tag.

The processing stations also comprise a rotary carousel R (preferably rotating about a horizontal axis) having a plurality of radial grippers P configured to retain corresponding filter bags I being formed.

In short, the carousel R defines a conveyor of the filter bag I, along an arc-shaped path, in such a way as to reach the other operating stations 2 to allow the complete formation of the filter bag I. For example, the machine 1 may comprise a first processing station 2*a* wherein the doses of substance for infusion (contained in a hopper 2*b*) are placed, at predetermined distances, on a continuous strip formed by filter material "M".

The machine 1 may also comprise a second processing station 2*c* wherein the continuous strip on which the doses are placed is cut and folded to define the shape of the infusion product "I" to which the thread "F" is also applied (for example during the passage of the filter bag I being formed on a gripper P of the carousel R).

As mentioned, the machine 1 also comprises a series of processing stations in which the operations for forming the filter bag "I" moving on the carousel R are completed.

A third station 2*d* feeds a tag "E" to be applied to the filter bag being formed (tag separated from a continuous web). The tag "E" is then associated with the filter bag "I" and with the thread "F".

A fourth processing station 2*e* wherein a continuous web of overwrapping material "S" is cut into pieces and wrapped around the filter bag "I" completing its formation.

As mentioned, the movement of the filter bag "I" through the various processing stations 2 and therefore along the entire processing path is performed by means of the above-mentioned rotary carousel R having the radial grippers defining seats designed to receive and retain the filter bags "I" being formed and then supplying them in sequence to the various processing stations 2 during its rotation.

The machine 1 also comprises an extraction station 3 situated immediately downstream of the processing path and which receives from the carousel R the filter bags "I" formed to allow the extraction from the machine 1.

More specifically, the extraction station 3 comprises a stacking unit 4 comprising a guide channel 4*b* having a rectilinear stretch and configured to allow the ordered and continuous feeding of the filter bags I superposed to form a stack to be extracted from the machine 1. In other words, the infusion products "I" ready to be packaged are progressively transferred and aligned in the guide channel 4*a* from which they can be picked up (manually) by an operator who will then insert them in a suitable container.

As illustrated, the extraction station 3 comprises transfer means 5 configured for transferring the filter bags I coming from the processing path to the stacking unit 4.

In light of this, the transfer means 5 individually pick up the filter bags I from the plurality of grippers P of the carousel R.

Structurally, the stacking unit 4 further comprises a connecting element 4*a*, positioned downstream of the processing stations 2 and upstream of the guide channel 4*b*.

The connecting element 4*a* is configured to receive as input from the transfer means 5 the filter bags I coming from the processing path. Moreover, the connecting element 4*a* is connected at the outlet with the guide channel 4*b* in which the filter bags I are introduced before being extracted from the machine.

The connecting element 4*a* also comprises a chute surface having a curved stretch shaped to allow the feeding of the filter bags I along a feed direction.

Basically, the complete guide channel has a first curved stretch designed to receive as input the infusion products "I" from the processing path and a second flat stretch (both open at the top), in such a way as to allow, if necessary and at any time, an operator to access the infusion products "I", in particular to perform the extraction from the machine 1.

The above-mentioned transfer means 5 are configured and actuated in such a way as to pick up individually in succession the filter bags I from an outfeed station U forming part of the plurality of processing stations 2 and positioning individually, in succession, the filter bags I according to an orientation such as to form a stack of filter bags I superposed on each other along the feed direction and with the respective faces 1*a*, 1*b* with larger dimensions positioned transversal to the feed direction and with the respective bottoms 1*f* positioned side by side resting on the chute surface of the connecting element 4*a*.

More in detail, the curved stretch of the connecting element 4*a* has a curvature such as to define, along the feed direction, a feed path for the filter bags "I" having a circular arc shape.

The circular arc extends between an inlet wherein the filter bags "I" are positioned by the transfer means 5 according to a first orientation (almost horizontal) and the outlet wherein the filter bags "I" perform a rotation, after having travelled along the curved stretch, preferably not greater than 90° and greater than 35°, to be positioned according to a second orientation (substantially vertical) different from the first orientation.

In other words, the first stretch 4*a* has a circular arc shape which allows an inlet of the guide channel 4 positioned in such a way as to favour and promote the insertion of the infusion products "I" whilst at the outfeed they are joined in an optimum manner with the second stretch 4*b*, which is preferably positioned in a substantially horizontal manner, to facilitate extraction of the products by an operator.

Moreover, the connecting element 4*a* of the stacking unit 4 comprises lateral facing surfaces (thus facing towards the inside of the channel) which converge in the infeed direction, designed to favour at least a partial retaining of the filter bags "I" by interference with the respective sides of the filter bags I.

In general, therefore, the inner surfaces of the first stretch 4*a* are located at a distance from each other less than the lateral dimensions or lateral size of the infusion product "I", in such a way as to guarantee that the product cannot adopt incorrect orientations (incline, for example) during its movement.

This convergence may be obtained, for example, by a step made at the inlet of the first stretch 4*a*, or by a gradual and progressive variation of its thickness.

Alternatively, the reduction in the width of the guide channel 4 inside the first stretch may be achieved by means of a pair of plates "PA" coupled to the inner surfaces of the side walls of the connecting element 4*a*.

The side walls may also be movable away from/towards each other, in such a way as to allow an operator to adapt the width of the guide channel 4*b* as a function of the dimensions of the filter bags "I" which the machine 1 must process.

This feature is particularly advantageous if it is necessary to change the size of the machine 1, for example when changing from products without overwrapping to products which have it or vice versa.

The guide channel 4*b* comprises, on the other hand, a motor-driven conveyor belt 9 positioned at a relative lower surface (that is, the one on which the filter bags "I" rest), configured for promoting a controlled feed of the products once they come out from the connecting element 4*a* and up to their removal by the operator.

As mentioned above, the extraction station 3 further comprises the transfer means 5.

The transfer means 5 are made using a gripper 5*a* movable between a picking up position in which it picks up the filter bags "I" along the processing path (that is, from the outfeed station U) and a release position close to the connecting element 4*a* for releasing the filter bags "I" in the connecting element 4*a*.

Operatively, the gripper 5*a* is moved to the picking up position moving it towards the processing path until engaging and gripping a finished infusion product "I" by a gripper P of the carousel R and ready to be boxed and then moved to the release position, moving it to the connecting element 4*a* in such a way that the infusion product "I" is in a position such as to enter it once released by the gripper 5*a*.

To facilitate the entrance of the infusion products "I" inside the first stretch 4*a*, the machine 1 further comprises pushing means 6 configured to intercept the infusion products "I" at the infeed of the connecting element 4*a*, pushing them in such a way as to make them slide inside it.

In this way it is possible to prevent the accidental falling of infusion products "I" during their transfer to the connecting element 4*a* and the correct preparation of a succession of products which is actually continuous and ordered.

In light of this, the pushing means 6 are configured to be actuated in a synchronous fashion with the transfer means 5 in such a way as to pull the filter bag I as soon as it is released by the transfer means 5.

In detail, the pushing means 6 comprise a pair of fingers 6*a* configured to allow the transfer means 5 to pass between them.

In particular, the pair of fingers 6*a* is at least partly inserted in the stacking unit 4 and slidable in at least a part of the connecting element 4*a*.

The pair of fingers 6*a* may be pivoted above the connecting element 4*a* in such a way that its rotational movement can follow the arched profile of the connecting element 4*a*, in particular at its inlet.

The machine 1 also comprises lifting means 7 acting on the connecting element 4*a* for lifting a single filter bags "I" relative to the stack of filter bags "I" superposed and advancing along the connecting element 4*a*.

This feature makes it possible to make in the succession of products references which make it possible to identify successions/separations of groups of products each comprising a predetermined number of filter bags "I" which corresponds to the number of products which must be inserted in each box or container.

In other words, the lifting means 7 periodically lift the succession of products by lifting the filter bags "I" at regular intervals and therefore located at a predetermined reciprocal distance.

In this way, a visual indicator (flag) is provided which allows the operator to identify immediately and easily where the group of products starts and finishes, containing the exact number of filter bags "I" which must be picked up and boxed.

Structurally, the lifting means 7 comprise a lever 7*a* positioned on the chute surface of the connecting element 4*a*, in particular at a lower surface of the connecting element 4*a*.

The lever 7*a* is movable between a lowered home position wherein it acts in conjunction to define, with the chute surface, a shared lower surface of the connecting element 4*a* on which the filter bags "I" slide, and a raised operating position, wherein the lever 7*a* is positioned at a certain height relative to the chute surface, in such a way as to intercept and lift a filter bag "I" sliding inside the connecting element 4*a*.

Preferably, the lever 7*a* is pivoted at a relative end at the lower surface of the connecting element 4*a* and the passage from the home position to the operating position and vice versa is performed by a rotational motion.

Alternatively, the lever 7*a* could be moved in a linear fashion perpendicularly to the lower surface, causing a progressive insertion in the connecting element 4*a*, when moved from the home position to the operating position.

The extraction station 3 also comprises an end of stroke element 8 positioned in the guide channel 4*b* and slidable inside it and configured for making contact against the filter bag I in a more advance position of said succession of stacked products.

In other words, the end of stroke element 8 is configured for making contact against a first filter bag "I" of the succession of products in such a way as to keep it in the correct position, thus guaranteeing that the succession of products remains ordered and compact.

In this way it is also possible to guarantee that the products which have been raised by the lifting means 7 do not fall, being aligned with the other products, under the effect of the force of gravity.

In fact, the products which have been raised are held in position under the action of the pressure applied by the adjacent products and generated also thanks to the action of the end of stroke element 8.

In order to optimise the operation of the end of stroke device 8, the outfeed station 3 comprises elastic means which are active on it, in such a way as to keep it securely in contact against the first filter bag "I".

For this reason, even during and after the removal of a group of infusion articles by the operator, the elastic means ensure that the end of stroke element 8 is returned automatically and quickly in contact with the new first filter bag "I", thereby avoiding in this way that the succession of products unpacks, resulting in a re-alignment of the predetermined products which have been raised and the consequent loss of the reference which allows the operator to identify the start and end point of the individual groups.

The invention also provides a method for making filter bags "I" with infusion products.

The method comprises the following steps:

preparing a processing path along which the filter bags I are formed;

picking up individually the filter bags I at the end of the processing path;

releasing in succession filter bags I picked up on a connecting element 4*a* of a stacking unit 4 according to an inlet orientation such as to form a stack of filter bags I superposed on each other along a feed direction, with the respective large faces 1*a*, 1*b* positioned transversal to the feed direction and with the respective bottoms 1*f* positioned alongside each other resting on an arched chute surface of the connecting element 4*a;* introducing, by pushing, the filter bags I stacked and in succession from each other by the connecting element 4*a* in an adjacent guide channel 4*b* of the stacking unit 4 for forming a group of stacked filter bags I to be extracted, wherein the introduction in the guide channel 4*b* occurs according to an outlet orientation different from the infeed orientation and after the filter bags I have rotated along the curved chute surface.

Preferably, between the releasing step and the step of introducing into the guide channel, the filter bags I perform a rotation preferably not greater than 90° and greater than 35°, to be positioned according to the outlet orientation.

Preferably, between the releasing step and the introducing step there is a step of lifting a single filter bag I relative to the stack of superposed filter bags I.

It should be noted that the bottom 1*f* of the filter bag I, whilst it moves forward along the chute surface, travels along an arcuate stretch having a length greater than the stretch travelled by the top 1*c* of the filter bag I.

Advantageously, the invention achieves the preset aims overcoming the drawbacks of the prior art by providing the user with a packaging machine which is structurally simple and compact which allows the infusion products "I" made by their processing path to be extracted in a simple and efficient manner. In particular, the geometry of the extraction station makes it possible to have each filter bag inserted at the infeed always constantly controlled during its feeding through simple mechanical systems and which is able to modify their angular position through the constant feeding towards the outfeed.

Moreover, the arc-shaped stretch allows auxiliary operations to be performed, such as the lifting of the filter bag "flag" during the first inlet, and may be adjusted as a function of the type and movement of the transfer means.

The invention claimed is:

1. A packaging machine for making filter bags with infusion products, said filter bags comprising at least one closed containment chamber having two large faces facing each other which extend from a bottom, said bottom having a smaller extension than said two large faces, said machine comprising:

a plurality of processing stations defining a processing path and configured for making the filter bags and an extraction station situated immediately downstream of the plurality of processing stations relative to the processing path;

said extraction station comprising:

a stacking unit comprising a guide channel having a rectilinear stretch and configured to allow an ordered and continuous feeding of the filter bags superposed on one another to form a stack to be extracted from the machine;

a transfer device including a gripper configured for transferring said filter bags coming from the processing path to said stacking unit;

said stacking unit further comprising a connecting element positioned downstream of the plurality of processing stations and upstream of the guide channel, and configured for receiving as input from the transfer device the filter bags coming from the processing path; said connecting element connecting an outlet with the guide channel in which the filter bags are introduced before being extracted from the machine, and comprising a chute surface having a curved stretch shaped to allow feeding of the filter bags along a feed direction, and said transfer device being configured and actuated to pick up individually in succession the filter bags from a station of said plurality of processing stations and positioning individually in succession the filter bags arranged according to an orientation to form the stack of filter bags superposed on each other along the feed direction, with the respective two large faces positioned transversal to the feed direction and with the respective bottoms positioned side by side resting on the chute surface of the connecting element;

a pushing device configured to promote insertion and guided sliding of the filter bags inside the connecting element of the stacking unit, the pushing device comprising a pair of fingers configured to allow the transfer device to pass between the fingers.

2. The machine according to claim 1, wherein the curved stretch of the connecting element has a curvature defining, along the feed direction, a circular arc feed path for the filter bags, said circular arc feed path extending between an inlet wherein the filter bags are positioned by the transfer device according to a first orientation and the outlet wherein the filter bags perform a rotation, after moving along the curved stretch, of greater than 35° and not greater than 90°, to position according to a second orientation different from the first orientation.

3. The machine according to claim 1, wherein the connecting element of the stacking unit comprises side walls facing and converging in an inlet direction configured to favour at least a partial retaining of the filter bags by interference with respective sides of the filter bags.

4. The machine according to claim 1, wherein the transfer device gripper is movable between a picking up position where the gripper is located along the processing path for picking up the filter bags from a station of said plurality of processing stations and a release position close to the connecting element for releasing the filter bags in said connecting element.

5. The machine according to claim 1, wherein the pushing device is configured to be actuated in a synchronous fashion with the transfer device to pull each of the filter bags as soon as the each of the filter bags is released by the transfer device.

6. The machine according to claim 1, and further comprising a lifting device including a lever acting on the connecting element for lifting a single one of the filter bags relative to the stack of filter bags and feeding the single one of the filter bags along said connecting element.

7. The machine according to claim 6, wherein the lever is positioned on the chute surface of the connecting element and is movable between a lowered home position wherein said lever acts in conjunction with the chute surface to form a shared lower surface of the connecting element and a raised operating position wherein the lever is positioned at a certain height relative to the chute surface.

8. The machine according to claim 1, wherein the extraction station comprises an end of stroke element slidable in the guide channel and configured for making contact against one of the filter bags in a more advanced position of said succession of stacked filter bags.

9. The machine according to claim 1, wherein said plurality of processing stations comprise a rotary carousel having a plurality of radial grippers configured to retain corresponding one of the filter bags being formed; said transfer device picking up individually the filter bags from said plurality of radial grippers of said carousel.

10. A method for making filter bags with infusion products, each of the filter bags comprising at least one closed containment chamber and having two large faces facing each other and two sides which extend from a bottom and a top, said bottom and said top having a smaller extension than both of the two large faces and of the sides, said method comprising the following steps:

preparing a processing path along which the filter bags are formed;

picking up individually the filter bags at an end of the processing path;

releasing in succession the filter bags picked up on a connecting element of a stacking unit according to an inlet orientation to form a stack of the filter bags superposed on each other along a feed direction, with the respective two larger faces positioned transversal to the feed direction and with the respective bottoms positioned side by side resting on an arched chute surface of the connecting element;

introducing, by pushing, the filter bags stacked and in succession from each other by the connecting element in an adjacent guide channel of the stacking unit for forming a group of stacked filter bags to be extracted, wherein the introduction in the guide channel occurs according to an outlet orientation different from the infeed orientation and after the filter bags have rotated along the curved chute surface;

wherein between the release step and the step of introducing into the guide channel, the filter bags perform a rotation of greater than 35° and not greater than 90°, to be positioned according to the outlet orientation.

11. The method according to claim 10, and further comprising a step of lifting a single one of the filter bags relative to the stack of superposed filter bags performed between the releasing step and the introducing step.

12. The method according to claim 10, and further comprising causing the bottoms of the filter bags, while moving along the chute surface, to travel along an arcuate stretch having a length greater than a length of the arcuate stretch travelled by the tops of the filter bags.

13. A packaging machine for making filter bags with infusion products, said filter bags comprising at least one closed containment chamber having two large faces facing each other which extend from a bottom, said bottom having a smaller extension than said two large faces, said machine comprising:

a plurality of processing stations defining a processing path and configured for making the filter bags and an extraction station situated immediately downstream of the plurality of processing stations relative to the processing path;

said extraction station comprising:

a stacking unit comprising a guide channel having a rectilinear stretch and configured to allow an ordered and continuous feeding of the filter bags superposed on one another to form a stack to be extracted from the machine;

a transfer device including a gripper configured for transferring said filter bags coming from the processing path to said stacking unit;

said stacking unit further comprising a connecting element positioned downstream of the plurality of processing stations and upstream of the guide channel, and configured for receiving as input from the transfer device the filter bags coming from the processing path; said connecting element connecting an outlet with the guide channel in which the filter bags are introduced before being extracted from the machine, and comprising a chute surface having a curved stretch shaped to allow feeding of the filter bags along a feed direction, and said transfer device being configured and actuated to pick up individually in succession the filter bags from a station of said plurality of processing stations and positioning individually in succession the filter bags arranged according to an orientation to form the stack of filter bags superposed on each other along the feed direction, with the respective two large faces positioned transversal to the feed direction and with the respective bottoms positioned side by side resting on the chute surface of the connecting element;

a lifting device including a lever acting on the connecting element for lifting a single one of the filter bags relative to the stack of filter bags and feeding the single one of the filter bags along said connecting element.

* * * * *